US006372710B2

(12) United States Patent
Sadoyama

(10) Patent No.: US 6,372,710 B2
(45) Date of Patent: Apr. 16, 2002

(54) DETERGENT COMPOSITION AND PROCESS FOR PRODUCING COMPOSITION THEREOF

(76) Inventor: Yasuo Sadoyama, 3144, Aza Noborikawa, Okinawa City, Okinawa Prefecture (JP)

( * ) Notice: Subject to any disclaimer, the term of this patent is extended or adjusted under 35 U.S.C. 154(b) by 0 days.

(21) Appl. No.: 09/867,443

(22) Filed: May 31, 2001

(30) Foreign Application Priority Data

May 31, 2000 (JP) ..... 2000-161931

(51) Int. Cl.[7] ..... C11D 3/06; C11D 3/08; C11D 3/10

(52) U.S. Cl. ..... 510/531; 510/509; 510/510; 510/511; 510/512; 510/534

(58) Field of Search ..... 510/531, 509, 510/510, 511, 512, 534

(56) References Cited

U.S. PATENT DOCUMENTS 4,081,395 A * 3/1978 Talley ..... 252/106

* cited by examiner

*Primary Examiner*—Charles Boyer
(74) *Attorney, Agent, or Firm*—Armstrong, Westerman, Hattori, LLP

(57) ABSTRACT

The invention of this application aims to offer the detergent composition that does not destroy natural ecosystem or pollute air, as the detergent contains neither organic synthetic surfactant that pollutes environment, rivers and lakes nor petroleum volatile solvent that is the source of air pollution. The invention of this application concerns the detergent composition and manufacturing methods of said detergent. The detergent composition contains at least one or more species of sodium (III) phosphate, sodium metasilicate, sodium sulfate, sodium tripolyphosphate, sodium chloride, sodium carbonate, potassium chloride, trisodium citrate and sodium hydroxide.

13 Claims, 1 Drawing Sheet

[Figure 1]
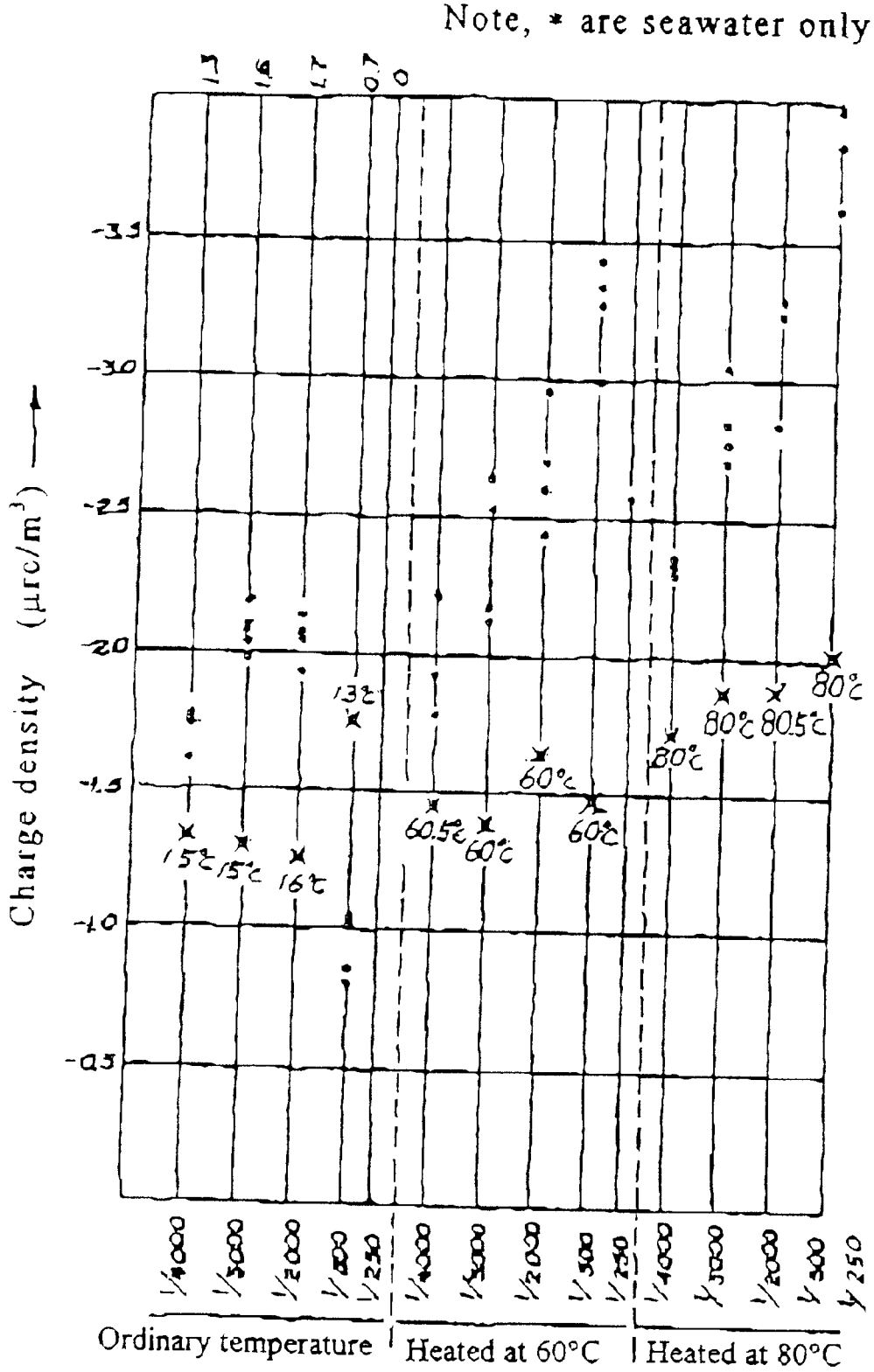

DETERGENT COMPOSITION AND PROCESS FOR PRODUCING COMPOSITION THEREOF

DETAILED DESCRIPTION OF THE INVENTION

1. Field of the Invention

The invention of the present application relates to a detergent composition for uses at home as in kitchen equipment and industrial uses in factory and a process to produce the composition thereof.

2. Prior Art

Up to now, natural substances had been used or processed for use as detergent and cleaning agents. Consequently, there was no harm to humans, and also there was not environmental pollution.

On the contrary, since synthetic detergents and,surfactants have been developed and utilized, the pollution of environment, especially that of lakes and rivers, has appeared and has been indicated as social problems.

In addition, along with mass production of electronic parts and mass processing of metal parts, dry cleaning using such detergents as trichlen and flon are incorporated in production lines at factories, requiring a large amount of solvent detergents and causing global air pollution.

PROBLEM THAT THE INVENTION AIMS TO SOLVE

The invention of this application solves the above-mentioned problems. The detergent composition of the invention of this application includes neither organic synthetic surfactant that pollutes environment, rivers and lakes nor petroleum volatile solvent that is the source of air pollution. Under such circumstances, it is an object of the invention aims to provide detergent composition that does not cause a waste of the natural ecosystem or pollute air.

MEANS TO SOLVE THE PROBLEM

The invention of this application relates to a detergent composition which consists of sodium (III) phosphate, sodium metasilicate, sodium sulfate, sodium tripolyphosphate, sodium chloride, and at least one or more compounds selected from sodium carbonate, potassium chloride, trisodium citrate and sodium hydroxide. As mentioned above, a manufacturing and a washing method are also included in the present invention.

MODE OF OPERATION OF INVENTION

The suitable mode of operation of the invention is explained below.

It is preferable for the detergent constituents of the invention of this application to be made using inorganic salt of (III) phosphoric acid, inorganic salt of metasilicic acid, inorganic salt of sulfuric acid, inorganic salt of tripolyphosphoric acid, chlorides, inorganic salt of carbonic acid, tri-inorganic salt of citric acid, hydroxides, inorganic salt of boric acid, and inorganic salt of pyrophosphoric acid. More preferable is the detergent composition consisiting of potassium salt or sodium salt.

Furthermore, it is preferable to contain sodium borate and/or potassium pyrophosphate.

It is preferable for the detergent composition of the invention of this application to contain at least one or more species of sodium pyrophosphate and potassium carbonate.

It is also preferable for the composition of the invention of this application to have the ratio of each component against the whole composition based on weight such as; sodium (III) phosphate in an amount of about 3.5 to 40% by weight, sodium metasilicate in an amount of about 4 to 35% by weight, sodium sulfate in an amount of about 3 to 15% by weight, sodium borate in an amount of about 0 to 18% by weight, potassium pyrophosphate in an amount of about 0 to 50% by weight, sodium pyrophosphate in an amount of about 0 to 50% by weight, sodium tripolyphosphate in an amount of about 3 to 50% by weight, potassium carbonate in an amount of about 0 to 25% by weight, sodium carbonate in an amount of about 0 to 50% by weight, sodium chloride in an amount of about 6 to 50% by weight, potassium chloride in an amount of about 0 to 30% by weight, trisodium citrate in an amount of about 0 to 50% by weight, and sodium hydroxide in an amount of about 0 to 8% by weight.

In washing by using solution consisting of the composition according to the invention of this application, it is preferable for hydrogen ion exponent as adjusted so as to be pH 10.2 to 13.4, and water temperature within 40 to 80° C.

It is preferable for solution of the compositions of the invention of this application to be used to wash electronic parts and semiconductors.

It is preferable the compositions of the invention of this application to use for face wash, body, hair, tooth brushing, kitchen, building, laundry, pets and industry in factory.

Of industrial uses, washing of electronic parts, shipping, aircraft and tanks for stock or an oil reservoir is preferable.

AS a face washing detergent, composition consisiting of sodium (III) phosphate, sodium metasilicate, sodium sulfate, sodium pyrophosphate, sodium tripolyphosphate, sodium carbonate, sodium chloride and potassium chloride is preferable. Furthermore, it is preferable to add potassium carbonate in place of sodium pyrophosphate.

In addition, carboxymethylcellulose and perfume may be added.

With respect to detergent for body, it is preferable to use sodium (III) phosphate, sodium metasilicate, sodium sulfate, sodium pyrophosphate, sodium tripolyphosphate, sodium carbonate, sodium chloride, and potassium chloride. Furthermore, it is preferable to add potassium carbonate in place of sodium pyrophosphate.

In addition, carboxymethylcellulose, inorganic foaming agent and perfume may be added.

With respect to detergent for hair, it is preferable to use sodium (III) phosphate, sodium metasilicate, sodium sulfate, sodium pyrophosphate, sodium tripolyphosphate, sodium carbonate, sodium chloride, and potassium chloride. Furthermore, it is preferable to add potassium pyrophosphate, potassium carbonate, and trisodium citrate in place of sodium pyrophosphate.

In addition, silicone resin, carboxymethylcellulose, and perfume may be added.

With respect to detergent for household use, it is preferable to use sodium (III) phosphate, sodium metasilicate, sodium sulfate, sodium pyrophosphate, sodium tripolyphosphate, sodium carbonate, sodium chloride, and potassium chloride. Furthermore, it is preferable to add potassium pyrophosphate and potassium carbonate instead of sodium pyrophosphate.

With respect to detergent for laundry, it is preferable to use sodium (III) phosphate, sodium metasilicate, sodium sulfate, sodium borate, potassium pyrophosphate, sodium tripolyphosphate, potassium carbonate, sodium chloride, and potassium chloride. Furthermore, it is preferable to add sodium carbonate and sodium hydroxide.

In addition, carboxymethylcellulose and perfume may be added.

With respect to detergent for brushing teeth, it is preferable to mix, stir and dissolve homogeneously sodium (III) phosphate, sodium metasilicate, sodium sulfate, carboxymethylcellulose, sodium pyrophosphate, sodium tripolyphosphate, sodium carbonate, sodium chloride, potassium carbonate, calcium chloride, magnesium chloride, calcium carbonate, foaming agent, sodium hydrogen fluoride, saccharin sodium and mint oil. If necessary, vegetable essential oil can be added. In addition, optimal dose of enzyme or perfume may suitably be added if desired and needed.

With respect to detergent for industrial use, it is preferable to use sodium (III) phosphate, sodium metasilicate, sodium sulfate, sodium borate, potassium pyrophosphate, sodium tripolyphosphate, potassium carbonate, sodium chloride, potassium chloride, and sodium hydroxide. Furthermore, it is preferable to add sodium carbonate.

In addition, carboxymethylcellulose and the like may be added.

The detergent of the invention of this application, while weak on foaming capacity against soil such as fats, oils and protein adhering to the surface of subjects of washing, is strong on decreasing surface tension, infiltrating, moistening, dispersing and dissolving soil by hydrolysis into detergent solution.

Furthermore, the detergent of the invention of this application can be shorten relatively for rinsing treatment using water or warm water, unlike conventional soaps or synthetic detergents that require long time for rinsing process. In addition, the washing effect of this detergent is satisfactory, even when seawater is used, which has been said to be unsuitable for use with soaps and synthetic detergents. Soils such as oils and fats can be easily removed with this detergent, using seawater.

It is preferable to use soft water instead of hard water with the detergent of the invention of this application. The hardness of water should be not higher than 100 ppm and the lower the hardness the better it is.

To the detergent composition, the following at the designated ratio can be added as needed according to uses; silicone resin in an amount of about 0.5 to 4% by weight, perfume in an amount of about 0.1 to 2% by weight, essential oil extracted from medicinal herbs, etc. in an amount of about 0.1 to 2% by weight, carboxymethylcellulose in an amount of about 0.1 to 3% by weight, organic or inorganic foaming agents such as alkyl glycoside in an amount of about 0.5 to 20% by weight or sodium hydrogen fluoride in an amount of about 0.2 to 5% by weight.

The following is the method for producing of detergent undiluted solution in which the detergent composition of the invention of this application is dissolved. To water, added were sodium (III) phosphate, sodium metasilicate, and sodium sulfate. It was stirred and dissolved well, and mixed with sodium borate and potassium pyrophosphate. Newly added in succession were sodium pyrophosphate, sodium tripolyphosphate, potassium carbonate, sodium carbonate, sodium chloride, potassium chloride, tri-sodium citrate and sodium hydroxide, and were stirred to dissolve.

It is particularly effective, when detergent undiluted solution is produced as follows. To 40 to 80° C. water of approximately 1,000% by weight, added were detergent composition of sodium (III) phosphate in an amount of about 7 to 40% by weight, sodium metasilicate in an amount of about 8 to 35% by weight, and sodium sulfate in an amount of about 3 to 15% by weight. It was stirred and dissolved well. Added were sodium borate in an amount of about 0.5 to 18% by weight and potassium pyrophosphate in an amount of about 6 to 50% by weight. Newly added in succession were sodium pyrophosphate in an amount of about 6 to 50% by weight, sodium tripolyphosphate in an amount of about 6 to 50% by weight, potassium carbonate in an amount of about 3 to 25% by weight, sodium carbonate in an amount of about 6 to 50% by weight, sodium chloride in an amount of about 6 to 50% by weight, potassium chloride in an amount of about 8 to 30% by weight, trisodium citrate in an amount of about 15 to 50% by weight, and sodium hydroxide in an amount of about 0.5 to 8% by weight, and were stirred to dissolve.

In producing the solution of the detergent based on the invention of this application, the following mixing ratio can be designed and dissolved by the objection for uses: silicone resin in an amount of about 0.5 to 4% % by weight, perfume in an amount of about 0.1 to 2% by weight, essential oil extracted from medicinal herbs in an amount of about 0.1 to 2% by weight, carboxymethylcellulose in an amount of about 0.1 to 3% by weight, organic or inorganic foaming agents such as alkyl glycoside in an amount of about 0.5 to 20% by weight or sodium hydrogen fluoride in an amount of about 0.2 to 5% by weight.

The following also can be added; calcium chloride, magnesium chloride, calcium carbonate, saccharin sodium, mint oil, and montmorillonite.

Undiluted solution of the detergent composition of the invention in this application to be dissolved in water is effective, when pH is alkaline within pH 10.2 to 13.4 as hydrogen ion exponent.

The undiluted solution produced by dissolving the detergent composition of the invention of this application is used as detergent solution for laundry or washing by adding water or seawater 0 to 5,000 times according to uses.

The detergent solution prepared by adding water to the undiluted detergent solution of the invention of this application can increase its effectiveness in laundry and washing by using in pressure spray, mixing, shaking, brushing, ultrasonic vibration and an ordinary temperature of 80° C.

The detergent solution of the invention in this application can be reused by recovering solution, which is soiled in laundry or washing and from which soils, oils and fats are scoured out by separating an oily substance from water, or using ultrasonic separation or filtration. It is preferable to adjust a temperature and pH of the solution when using or prior to reuse.

EXAMPLES

The present invention will be described below in detail by way of example.

Example 1

First, 15.00 kg of sodium sulfate, 7.50 kg of sodium tertiary phosphate and 13.13 kg of sodium metasilicate were added into 1000 kg of soft water warmed to 40° C. while they were stirred and dissolved well in the soft water. Then, 33.75 kg of carboxymethyl cellulose, 18.75 kg of sodium pyrophosphate, 9.25 kg of sodium carbonate and 18.75 kg of sodium tripolyphosphate were added thereto successively while dissolved therein. Thus, an undiluted solution of a detergent composition for facial cleansing was produced.

The undiluted solution and a detergent solution diluted 300 times with soft water were analyzed as to whether or not a waste liquid run off into a river after cleansing cleared the Waste Emission Standard and Environment Quality Standard defined in the Water Pollution Control Law. Results of the analysis are as shown in Table 1.

TABLE 1

| Sample name | Solution diluted 2000 times | Quantitation lower limit |
|---|---|---|
| PH | 10.0 | — |
| BOD (mg/l) | 3.0 | 0.5 |
| COD (mg/l) | 4.4 | 0.5 |
| SS (mg/l) | <1 | 1 |
| Alkalinity (pH 4.8) (mg equivalent/l) | 0.6 | 0.1 |
| Surfactant (ABS or LAS) | Not detected | 0.02 |
| Surfactant (non-ionic) | Not detected | 1 |
| Fluorescent whitening agent (mg/l) | Not detected | — |
| Arsenic | Not detected | 0.005 |
| Lead | Not detected | 0.005 |
| Cadmium | Not detected | 0.001 |
| Tin | Not detected | 0.2 |
| Copper | 0.003 | 0.001 |
| Zinc | 0.002 | 0.001 |
| Antimony | Not detected | 0.001 |
| Chromium | Not detected | 0.005 |
| Mercury | Not detected | 0.0005 |

"Not detected" indicates values below the quantitation lower limit.

"Waste Emission Standard" and "Limiting Standard" are standards defined in the "Water Pollution Control Law".

1) Values blow the quantitation lower limit are lower than 10 ppm and cannot be detected by a measuring apparatus.
2) Environmental Standard affecting living environment (lakes and marshes)
   -C- Industrial Water Class 2, Natural Environment Preservation
3) Environmental Standard affecting living environment (lakes and marshes)
   -AA- Piped Water Class 1, Fisheries Class 1, Natural Environment Preservation

Experiment 1

The undiluted solution was subjected to an acute toxicity test in fishes in terms of environmental pollution, particularly of rivers. The test on "Acute Toxicity Studies in Fishes" conducted by the Japan Food Center Foundation will be described.

Table 2 shows the relationship between the rate of dilution in each sample and the survival rate of fishes. Table 3 shows 24- and 48-hour TLm (median lethal concentration) measured upon orange-red type medaka (*Oryzias latipes* variant) in accordance with JIS K102 Industrial Waste Water Testing Methods (1971).

With respect to the tesiting condition, the average body length of orange-red type medaka was 3.1 cm and the average body weight thereof was 0.34 g. The temperature of test water was 25° C.±1° C. Artificial drinking water with pH of 7.0, alkalinity of 0.4 meq/L and hardness of 25 ppm was used as diluent water. The diluent water was prepared by adding inorganic salts to purified water. The ratio of the amount of test fishes to the amount of test water was about 1 g of fish body weight to 1 liter of test water.

TABLE 2

| Concentration | 24-hour survival rate (%) | 48-hour survival rate (%) |
|---|---|---|
| 3,500 | 75 | 50 |
| 2,500 | 100 | 95 |
| 1,750 | 100 | 100 |
| 1,200 | 100 | 100 |

TABLE 3

| | 24-hour TLm | 48-hour TLm |
|---|---|---|
| Concentration (ppm) | 2,500 | 2,325 |

Experiment 2

The undiluted solution will be described upon the case where a fat layer deposited on a reservoir tank is washed with a seawater solution.

In a conventional method of washing the fat layer deposited on the reservoir tank, the fat layer was scoured away by high-pressure spray of seawater alone and the mixture solution of fat and seawater was transported to land through pipes before the fat was separated from the seawater. The amount of the mixture solution was so enormous that it took much equipment, time and expense to process the mixture solution. A test using detergents or cleansing agents was also tried. Although the amount of the mixture solution of fat and seawater was reduced, static electricity was generated so that the oil tank was in danger of explosion. This measure was invalid.

The generated state of static electricity in the detergent according to the present invention was measured. As results of the measurement, FIG. 1 shows the relationship between temperature and electric charge density in various cleansing agents.

As is obvious from FIG. 1, the detergent according to the present invention has lower charge density at all temperature levels than other cleansing agents have. It is indicated that charge density of not higher than $-1.5\ \mu c/cm^3$ is preferred in order to prevent explosion accidents owing to static electricity. It was confirmed that the detergent according to the present invention was safe, because the charge density of the detergent was not higher than $-1.5\ \mu c/cm^3$ at 60° C. as well as at an ordinary temperature. Moreover, raising the temperature to 60° C. made it possible to improve the cleansing effect of the detergent solution greatly. Hence, waste water in the oil tank could be treated by using an extremely small amount of the detergent to thereby make it possible to achieve large reduction in personnel, treating time, the amount of waste material and treatment cost and prevention of seawater pollution.

Experiment 3

A solution of the undiluted diluted 300 times with water was analyzed and measured upon destruction of vitamin C in cleansing agricultural products such as vegetables. The results of the analysis are shown in Table 4. As is obvious from Table 4, the percentage of vitamin C destroyed by way of cleansing cabbage or radish is from 6 to 11% and is very little compared with other detergents.

TABLE 4

| Item of analysis Vitamin C | Before cleansing | After cleansing (solution diluted 300 times) | Undiluted solution | Solution diluted 300 times |
|---|---|---|---|---|
| Cabbage | 29.8 mg % | 27.5 mg % | | |
| Radish | 14.5 mg % | 12.9 mg % | | |
| PH | | | 12.1 | 10.6 |

Experiment 4

Into t he undiluted solution, 4% of sodium hydrogen fluoride were added and stirred well. The mixture solution was diluted 300 times with soft water to thereby prepare a diluted cleansing solution. When the diluted cleansing solution was used for cleansing dental surfaces, it was effective in removing dental plaque deposited on the dental surfaces .

Example 2

First, 60.00 kg of sodium sulfate, 30.00 kg of sodium tertiary phosphate and 52.50 kg of sodium metasilicate were added into 1000 kg of soft water warmed to 60° C. while they were stirred and dissolved well in the soft water. Then, 375.00 kg of potassium pyrophosphate, 23. 00 kg of sodium borate, 42. 00 kg of sodium hydroxide, 29.70 kg of carboxymethyl cellulose, 26.00 kg of potassium chloride, 37.00 kg of sodium carbonate, 75.00 kg of sodium tripolyphosphate, 37.00 kg of potassium carbonate and 26.00 kg of sodium chloride were added thereto successively and dissolved therein. Thus, an undiluted solution of a detergent composition for industrial use was produced.

Example 3

First, 51.00 kg of sodium sulfate, 25.50 kg of sodium tertiary phosphate and 44.63 kg of sodium temasilicate were added into 1000 kg of soft water warmed to 60° C. while they were stirred and dissolved well in the soft water. Then, 31.05 kg of carboxymethyl cellulose, 22.10 kg of potassium chloride, 63.75 kg of sodium pyrophosphate, 31.45 kg of sodium carbonate, 63.75 kg of sodium tripolyphosphate, 22.10 kg of sodium chloride, 22.10 kg of citric acid and 75.00 kg of foaming agent were added thereto successively and dissolved therein. Thus, an undiluted solution of a detergent composition for kitchen use was produced.

Example 4

First, 57.00 kg of sodium sulfate, 28.50 kg of sodium tertiary phosphate and 49.88 kg of sodium metasilicate were added into 1000 kg of soft water warmed to a temperature of 80° C. while stirring and were dissolved well in the soft water. Then, 71.25 kg of potassium pyrophosphate, 21.85 kg of sodium borate, 39.90 kg of sodium hydroxide, 31.05 kg of carboxymethyl cellulose, 24.70 kg of potassium chloride, 35.15 kg of sodium carbonate, 71.25 kg of sodium tripolyphosphate, 35.15 kg of potassium carbonate, 24.70 kg of sodium chloride, 24.70 kg of citric acid, 5.00 kg of perfume 1 and 69.35 kg of enzyme were added thereto while stirring, and dissolved therein. Thus, an undiluted solution of a detergent composition for laundry use was produced.

Example 5

First, 12.00 kg of sodium sulfate, 6.00 kg of sodium tertiary phosphate and 10.50 kg of sodium metasilicate were added into 1000 kg of soft water warmed to a temperature of 35° C., while stirring and dissolved well in the soft water. Then, 31.05 kg of carboxymethyl cellulose, 15.00 kg of sodium pyrophosphate, 7.40 kg of sodium carbonate, 15.00 kg of sodium tripolyphosphate, 75.00 kg of foaming agent and 5.00 kg of perfume 4 were added thereto while stirred and dissolved therein. Thus, the mixture solution obtained of a detergent composition for cleansing pet dogs was produced.

Example 6

First, 15.00 kg of sodium sulfate, 7.50 kg of sodium tertiary phosphate and 13.13 kg of sodium metasilicate were added into soft water warmed to a temperature of 40° C. while stirring and dissolved well in the soft water. Then, 31.05 kg of carboxymethyl cellulose, 29.90 kg of potassium chloride, 9.25kg of sodium carbonate, 18.75kg of sodium tripolyphosphate, 29.90 kg of sodium chloride, 75.00 kg of foaming agent and 2.15 kg of perfume 3 were added thereto while stirring and dissolved therein. The mixture thus obtained, an undiluted solution of a detergent composition for body washing such as a body soap was produced.

Example 7

First, 12.00 kg of sodium sulfate, 6.00 kg of sodium tertiary phosphate and 10.50 kg of sodium metasilicate were added into 1000 kg of soft water warmed to a temperature of 35° C. while stirring and dissolved well in the soft water. Then, 31.05 kg of carboxymethyl cellulose, 29.90 kg of potassium chloride, 15.00 kg of sodium pyrophosphate, 7.40 kg of sodium carbonate, 15.00 kg of sodium tripolyphosphate, 5.20 kg of sodium chloride, 7.40 kg of potassium carbonate, 75.00 kg of foaming agent, 2.15 kg of perfume 2, 7.00 kg of silicone resin, 12.00 kg of kaolin and 11.00 kg of montmorillonite were added thereto while stirring and dissolved therein. Thus, a mixure solution of a detergent composition for hair washing was produced.

Example 8

First, 15.00 kg of sodium sulfate, 7.50 kg of sodium tertiary phosphate and 13.13 kg of sodium metasilicate were added into 1000 kg of soft water warmed to a temperature of 35° C. while stirring, and dissolved well in the soft water. Then, 31.05 kg of carboxymethyl cellulose, 29.90 kg of potassium chloride, 18.75 kg of sodium pyrophosphate, 9.25 kg of sodium carbonate, 18.75 kg of sodium tripolyphosphate, 9.25 kg of potassium carbonate, 6.50 kg of sodium chloride, 12.50 kg of potassium chloride, 6.25 kg of magnesium chloride, 18.75 kg of potassium carbonate, 37.50 kg of foaming agent, 6.25 kg of sodium hydrogen fluoride, 5.00 kg of sodium saccharate and 5.00 kg of mint oil were added thereto while mixing with stirring and dissolved homogeneously therein. Thus, an mixture solution of a detergent composition for tooth brushing was produced.

What is claimed is:

1. A detergent composition which comprises sodium (III) phosphate, sodium metasilicate, sodium sulfate, sodium tripolyphosphate, sodium chloride, and at least one or more of compounds selected from sodium carbonate, potassium chloride, trisodium citrate and sodium hydroxide, wherein the ratio based on weight of each component to said whole composition is as follows; sodium (III) phosphate 3.5 to 40% by weight, sodium metasilicate 4 to 35% by weight, sodium sulfate 1.5 to 15% by weight, sodium tripolyphosphate 3 to 50% by weight, sodium carbonate 0 to 50% by weight, sodium chloride 6 to 50% by weight and sodium hydroxide 0 to 8 % by weight.

2. A detergent composition according to claim 1, said composition further comprises sodium borate, potassium pyrophosphate, sodium pyrophosphate, potassium carbonate and/or carboxymethylcellulose, wherein the ratio based on weight of each component to said whole composition is as follows; sodium borate 0 to 18% by weight, potassium pyrophosphate 0 to 50% by weight, sodium pyrophosphate 0 to 50% by weight, potassium carbonate 0 to 25% by weight and carboxymethylcellulose 0 to 3% by weight.

3. A method of manufacturing a detergent solution, wherein the detergent composition as defined in claim 1 or 2 is dissolved in water.

4. A solution obtained by the manufacturing method defined in claim 3, wherein said solution has a pH of from 10.2 to 13.4.

5. The manufacturing method as defined in claim 3, wherein a temperature of said water during said dissolving step is from 40° C. to 80° C.

6. A washing method comprising:

washing subjects with a detergent solution comprising the detergent composition as defined in claim 1 or 2 dissolved in water;

rinsing with water; and followed by drying.

7. The washing method according to claim 6, further comprising the steps of recovering said detergent solution used in said washing step and removing pollutants, fats and oils from said detergent solution.

8. The washing method according to claim 6, further comprising the step of removing pollutants, fats and oils from said water used for said rinsing step.

9. The washing method according to claim 6 further comprising the steps of reusing said detergent solution used in said washing step after removing pollutants, fats and oils therefrom.

10. A washing method according to claim 6, wherein said subjects are selected from the group consisting of electronic parts and semiconductors.

11. A washing method comprising the step of washing at least one of face, body and hair with a solution using the detergent composition according to claim 1 or 2.

12. A washing method comprising the step of washing at least one of a kitchen, building, laundry and pots with a solution using the detergent composition according to claim 1 or 2.

13. A washing method comprising the step of washing at least one of ships, aircraft and stock tanks or reservoir tanks with a solution using the detergent composition according to claim 1 or 2.

* * * * *